US012791200B2

(12) United States Patent
Armstrong et al.

(10) Patent No.: US 12,791,200 B2
(45) Date of Patent: Nov. 10, 2026

(54) WATER HEATING SYSTEM AND A CONTROLLER THEREFOR

(71) Applicant: Mixergy Limited, Oxfordshire (GB)

(72) Inventors: Peter Armstrong, Oxfordshire (GB); Christopher Randall, Oxfordshire (GB)

(73) Assignee: Mixergy Limited, Oxfordshire (GB)

( * ) Notice: Subject to any disclaimer, the term of this patent is extended or adjusted under 35 U.S.C. 154(b) by 23 days.

(21) Appl. No.: 18/716,520

(22) PCT Filed: Dec. 6, 2022

(86) PCT No.: PCT/GB2022/053103
§ 371 (c)(1),
(2) Date: Jun. 5, 2024

(87) PCT Pub. No.: WO2023/105210
PCT Pub. Date: Jun. 15, 2023

(65) Prior Publication Data

US 2025/0035320 A1 Jan. 30, 2025

(30) Foreign Application Priority Data

Dec. 7, 2021 (GB) ..... 2117638
Feb. 11, 2022 (GB) ..... 2201770

(51) Int. Cl.
*F24D 3/18* (2006.01)
*F24D 3/08* (2006.01)
(Continued)

(52) U.S. Cl.
CPC ..... *F24D 3/18* (2013.01); *F24D 3/08* (2013.01); *F24D 19/1006* (2013.01);
(Continued)

(58) Field of Classification Search
CPC ..... F24D 3/18; F24D 3/08; F24D 19/1006; F24D 17/02; F24D 11/0214; F24H 15/225
See application file for complete search history.

(56) References Cited

U.S. PATENT DOCUMENTS 5,269,153 A * 12/1993 Cawley ..... F24D 17/02 62/238.7
8,991,204 B2 * 3/2015 Otake ..... F24D 17/02 62/175
2013/0025301 A1 * 1/2013 Maitani ..... F24D 19/1012 62/159
2013/0074827 A1 * 3/2013 Kim ..... F24S 50/40 126/634
(Continued)

FOREIGN PATENT DOCUMENTS

EP 2306111 4/2011
EP 2306111 A1 * 4/2011 ..... F25B 40/00
(Continued)

OTHER PUBLICATIONS

International Search Report and the Written Opinion Dated Feb. 24, 2023 From the International Searching Authority Re. Application No. PCT/GB2022/053103. (15 Pages).

*Primary Examiner* — Lionel Nouketcha

(57) ABSTRACT

A heating system is provided. The heating system includes a heat pump to provide heat. The heating system includes a circuit of heat transfer fluid to transfer heat to or from the heat pump. The heating system includes a space heating system configured to transfer heat from the heat transfer fluid to an environment. The heating system includes a water heating system comprising a water tank for storing hot water to be provided to a user, a cold water inlet, a hot water outlet for drawing off hot water for supply to a user, and a heat exchanger configured to exchange heat between the heat transfer fluid and water from the cold water inlet. The heating system includes a means of sensing a tank status, the tank status being indicative of a quantity of thermal energy stored in the tank. The heating system includes a controller
(Continued)

adapted to control the transfer of heat to and from the tank in dependence on the tank status.

18 Claims, 8 Drawing Sheets

(51) Int. Cl.
*F24D 19/10* (2006.01)
*F24H 15/136* (2022.01)
*F24H 15/152* (2022.01)
*F24H 15/225* (2022.01)

(52) U.S. Cl.
CPC ..... *F24H 15/136* (2022.01); *F24H 15/152* (2022.01); *F24H 15/225* (2022.01)

(56) References Cited

U.S. PATENT DOCUMENTS

2013/0312443 A1* 11/2013 Tamaki ..... F25B 49/022 62/228.1
2014/0260392 A1* 9/2014 Hawkins ..... F24D 17/02 62/238.6
2014/0291411 A1* 10/2014 Tamaki ..... F24D 3/18 62/238.7
2018/0172287 A1* 6/2018 Göransson ..... F24H 15/375

FOREIGN PATENT DOCUMENTS

EP 3657091 A1 * 5/2020 ..... F24D 3/18
EP 3892925 10/2021
FR 2995979 3/2014
GB 2594337 10/2021
WO WO 2010/143373 12/2010

* cited by examiner

WATER HEATING SYSTEM AND A CONTROLLER THEREFOR

RELATED APPLICATIONS

This application is a National Phase of PCT Patent Application No. PCT/GB2022/053103 having International filing date of Dec. 6, 2022, which claims the benefit of priority of Great Britain Patent Application Nos. 2201770.1 filed on Feb. 11, 2022 and 2117638.3 filed on Dec. 7, 2021. The contents of the above applications are all incorporated by reference as if fully set forth herein in their entirety.

FIELD AND BACKGROUND OF THE INVENTION

The present invention relates to a system for heating water, in connection with a heat pump as heat source. Such a system may lend itself to use in domestic or commercial water heating systems where it is necessary or desirable to have a stored quantity of heated water for immediate use.

Heat pumps including both ground source heat pumps and air source heat pumps are becoming an increasingly popular option for space heating. Heat pump systems can include a buffer vessel that can serve as a heat reservoir. A buffer vessel can store heat and release it when opportune, for instance for a defrosting cycle of the heat pump, or to reduce on/off cycling of a heat pump as a dwelling is heated around its particular control set point temperature and hysteresis margin. Disadvantages of accommodating a buffer vessel include the requirement for additional space that may not be conveniently available, and also the addition of complexity in installing a heat pump system.

The present disclosure aims to alleviate some or all of the aforementioned problems.

SUMMARY OF THE INVENTION

According to a first aspect there is provided a heating system including: a heat pump to provide heat; a circuit of heat transfer fluid to transfer heat to or from the heat pump; a space heating system configured to transfer heat from the heat transfer fluid to an environment; a water heating system comprising a tank, a cold water inlet, a hot water outlet for drawing off hot water, and a heat exchanger configured to exchange heat between the heat transfer fluid and water from the cold water inlet; a means of sensing a tank status, the tank status being indicative of a quantity of thermal energy stored in the tank; and a controller adapted to control the transfer of heat to and from the tank in dependence on the tank status. Advantageously, the system may allow the tank to act as a virtual buffer tank such that heat from the tank may be transferred not just to water to be heated, but to a space heating system or back to the heat pump. A separate buffer tank need not be installed providing a simplified heating system. The tank may be used to store additional heat from the heat pump to be transferred back to the heat pump or space heating system at a later time. This can reduce the number of on/off cycles required of the heat pump.

In order to provide a more useful system, the controller may be configured to control a transfer of heat from the water heating system to the heat pump, preferably for defrosting the heat pump.

In order to provide a more efficient system, the controller may be configured to control a transfer of heat from the water heating system to the space heating system. This may help reduce the number of on/off cycles of a heat pump, since heat may on occasion be provided to space heating from the tank rather than the heat pump.

To increase safety of the system, the tank status may indicate whether the tank can safely receive heat. This may increase safety by preventing overheating of the tank.

For efficient use of heat the tank status may indicate a quantity of thermal energy stored in the tank above a temperature threshold. The temperature threshold may be associated with a minimum temperature for defrosting the heat pump and/or a minimum temperature for space heating and/or a minimum temperature for hot water supply.

The tank status may indicate a quantity of water stored in the tank above a temperature threshold, preferably above a minimum temperature for hot water supply. This may help maintain a minimum quantity of hot water available for a user.

To increase flexibility of the system, the tank status may be a state of charge of the tank. To further increase flexibility, the tank status may be a temperature profile of the tank.

To increase accuracy, the tank status may be in dependence on a position of a thermocline. The position of the thermocline may be determined by interpolation and/or integration methods from temperature measurements from vertically arranged temperature sensing units.

To increase accuracy, the means of sensing a tank status may comprise a plurality of temperature sensing units arranged vertically along the tank.

To increase utility, the controller may be configured to determine an amount of available heat to transfer from the tank in dependence on the tank status and, optionally, an anticipated heating demand. The anticipated heating demand may be an anticipated defrosting demand, and/or an anticipated space heating demand, and/or an anticipated hot water demand. The amount of available energy may be determined from a temperature profile using integration methods.

To increase flexibility, determining the amount of available heat may comprise determining a quantity of available thermal energy for defrosting the heat pump and/or a quantity of available heat for satisfying a space heating demand and/or a quantity of available heat for satisfying a hot water demand. A quantity of available thermal energy for defrosting the heat pump may be determined in dependence on a defrost threshold temperature. A quantity of available heat for satisfying a space heating demand may be determined in dependence on a space heating threshold temperature. A quantity of available heat for satisfying a hot water demand may be determined in dependence on a hot water threshold temperature.

In order to provide a more efficient system, the controller may be configured to control a transfer of heat from the heat pump to the water heating system in dependence on an electrical energy availability. This may help optimise electrical energy use of the heat pump, and therefore of the overall system.

In order to provide a more efficient system, the controller may be configured to control a transfer of heat from the water heating system to the space heating system and optionally to the heat pump in dependence on a minimum hot water quantity. This may help prevent a hot water demand exceeding a quantity of hot water available for a user.

In order to provide a simple method of implementing the system, the system may further comprise one or more actuators controlled by the controller to configure the heating system to one of several configurations. Preferably four configurations are available, wherein in a first configuration the heat pump provides heat to the space heating system and, optionally, to the tank; in a second configuration the heat pump provides heat to the tank and does not provide heat to the space heating system; in a third configuration the heat pump does not provide heat and the tank provides heat to the space heating system; and in a fourth configuration the heat pump does not provide heat and the tank provides heat to the heat pump.

In order to permit easy control of the system, the actuators may comprise two two-state actuators.

In order to provide a flexible system, a first actuator may be configured to control a transfer of heat to and from the tank and a second actuator may be configured to control a transfer of heat to the space heating system.

In order to provide a simple and efficient system, the first actuator may be a circulation pump configured to pump fluid through the heat exchanger. The first actuator may thereby help to prevent heat being inadvertently transferred to the tank where the heat exchanger is for example a plate heat exchanger.

In order to provide a simple and efficient system, the first actuator may be a diverter valve configured to control a flow of heat transfer fluid to the water heating system, preferably wherein the first actuator is configured to permit, in a first position, a flow of heat transfer fluid to the water heating system and to restrict, in a second position, a flow of heat transfer fluid to the water heating system. The first actuator may thereby help to prevent heat being inadvertently transferred to the tank, particularly where the heat exchanger is a coil disposed inside the tank.

In order to provide a simple and efficient system, the second actuator may be a diverter valve configured to control a flow of heat transfer fluid to the space heating system, preferably wherein the second actuator is configured to permit, in a first position, a flow of heat transfer fluid to the space heating system and to restrict, in a second position, a flow of heat transfer fluid to the space heating system. This may allow a simple mechanism for bypassing the space heating system when heat is not required for the space thereby to reduce heat losses.

In one alternative the tank may be a buffer tank for storing heat transfer fluid. This may obviate the need to for the tank to be a mains pressurized tank requiring associated safety features.

In one alternative the tank may be a water tank for storing water to be heated, this may provide for a system which may be implemented with existing hot water tanks.

Preferably the tank is a water tank for storing hot water to be provided to a user. Preferably the tank is a potable water storage tank. Preferably the tank is for pressurized storage of water. Preferably the tank is for storage of mains pressurized water. Preferably the tank is an unvented hot water storage tank. The water stored in the tank is preferably for supply to a user.

For effective heat exchange to and from the tank the heat exchanger may be a plate heat exchanger external to the tank.

For effective heat exchange to and from the tank, the heat exchanger may be arranged to return fluid to a first position in the tank and to receive fluid from a second position in the tank, the first position being higher than the second position.

For effective heat exchange to and from the tank, the heat exchanger may be arranged to return water to a first position in the tank and to draw water from a second position in the tank, the first position being higher than the second position.

For effective heat exchange into and out of the tank, a baffle may be provided. The baffle may reduce mixing between a first region of the tank above the baffle and a second region of the tank below the baffle. The heat exchanger may receive fluid from the second region and return fluid to the second region. The first portion may contain stratified water and the second portion may contain homogenous or mixed temperature water or unstratified water. The baffle may be arranged at or above the second position. The baffle may be a perforated plate. The baffle may extend across the tank.

For effective heat exchange to and from the tank the heat exchanger may be a conduit, preferably a coil, arranged inside the tank.

According to a second aspect there is provided a controller for a heating system, the controller including: a sensor module configured to receive tank status data from one or more sensors associated with a tank and heating system data from one or more sensors associated with a heat pump or a space heating system, the tank status data being indicative of an amount of thermal energy stored in the tank; and a control module configured to control a transfer of heat to and from a tank in dependence on the tank status data and the heating system data. Advantageously, the controller may allow the tank to act as a virtual buffer tank such that heat from the tank may be transferred not just to water to be heated, but to a space heating system or back to the heat pump. A separate buffer tank need not be installed providing a simplified heating system. The tank may be used to store additional heat from the heat pump to be transferred back to the heat pump or space heating system at a later time. This can reduce the number of on/off cycles required of the heat pump.

The tank is preferably a water tank for storing hot water to be provided to a user. Preferably the tank is a potable water storage tank. Preferably the tank is for pressurized storage of water. Preferably the tank is for storage of mains pressurized water. Preferably the tank is an unvented hot water storage tank. The water stored in the tank is preferably for supply to a user.

The tank status data may indicate a tank status which may be one or more of:

- indicative of whether the tank can safely receive heat;
- indicative of a quantity of thermal energy stored in the tank above a temperature threshold;
- indicative of a quantity of water stored in the tank above a temperature threshold, preferably above a minimum temperature for hot water supply;
- a state of charge of the tank;
- a temperature profile of the tank; and
- a position of a thermocline.

To increase safety, the tank status may indicate whether the tank can safely receive heat. This may increase safety by preventing overheating of the tank.

For efficient use of heat the tank status may indicate a quantity of thermal energy stored in the tank above a temperature threshold. The temperature threshold may be associated with a minimum temperature for defrosting the heat pump and/or a minimum temperature for space heating and/or a minimum temperature for hot water supply.

The tank status may indicate a quantity of water stored in the tank above a temperature threshold, preferably above a minimum temperature for hot water supply. This may help maintain a minimum quantity of hot water available for a user.

To increase flexibility of the system, the tank status may be a state of charge of the tank. To further increase flexibility, the tank status may be a temperature profile of the tank.

To increase accuracy, the sensor associated with the tank may comprise a plurality of temperature sensing units arranged vertically along the tank.

To increase accuracy, the tank status may be in dependence on a position of a thermocline. The position of the thermocline may be determined by interpolation and/or integration methods from temperature measurements from vertically arranged temperature sensing units.

To increase utility, the control module may be configured to determine an amount of available heat to transfer from the tank in dependence on the tank status and, optionally, an anticipated heating demand. The anticipated heating demand may be an anticipated defrosting demand, and/or an anticipated space heating demand, and/or an anticipated hot water demand. The amount of available energy may be determined from a temperature profile using integration methods.

To increase flexibility, determining the amount of available heat may comprise determining a quantity of available heat for defrosting the heat pump and/or a quantity of available heat for satisfying a space heating demand and/or a quantity of available heat for satisfying a hot water demand.

For versatility the control module may be configured to control a transfer of heat from the water heating system to the heat pump, preferably for defrosting the heat pump. For versatility the control module may be configured to control a transfer of heat from the water heating system to the space heating system. For robustness the control module may be configured to control one or more actuators to configure the heating system to one of several configurations. For ease of implementation the actuators may be two diverter valves; or a diverter valve and a circulation pump.

The controller may be adapted to control the system as aforementioned.

According to another aspect there is provided a method of controlling a heating system, the method including: receiving tank status data from one or more sensors associated with a tank, the tank status data being indicative of an amount of thermal energy stored in the tank and heating system data from one or more sensors associated with a heat pump or a space heating system; and controlling a transfer of heat to and from a tank in dependence on the tank status data and the heating system data.

Preferably the tank is a potable water storage tank. Preferably the tank is for pressurized storage of water. Preferably the tank is for storage of mains pressurized water. Preferably the tank is an unvented hot water storage tank. The water stored in the tank is preferably for supply to a user.

The tank status data may indicate a tank status which may be one or more of:

- indicative of whether the tank can safely receive heat;
- indicative of a quantity of thermal energy stored in the tank above a temperature threshold;
- indicative of a quantity of water stored in the tank above a temperature threshold, preferably above a minimum temperature for hot water supply;
- a state of charge of the tank;
- a temperature profile of the tank; and
- a position of a thermocline.

To increase safety, the tank status may indicate whether the tank can safely receive heat. This may increase safety by preventing overheating of the tank.

For efficient use of heat the tank status may indicate a quantity of thermal energy stored in the tank above a temperature threshold. The temperature threshold may be associated with a minimum temperature for defrosting the heat pump and/or a minimum temperature for space heating and/or a minimum temperature for hot water supply.

The tank status may indicate a quantity of water stored in the tank above a temperature threshold, preferably above a minimum temperature for hot water supply. This may help maintain a minimum quantity of hot water available for a user.

To increase flexibility of the system, the tank status may be a state of charge of the tank. To further increase flexibility, the tank status may be a temperature profile of the tank.

To increase accuracy, the one or more sensors associated with the tank may comprise a plurality of temperature sensing units arranged vertically along the tank.

To increase accuracy, the tank status may be in dependence on a position of a thermocline. The position of the thermocline may be determined by interpolation and/or integration methods from temperature measurements from vertically arranged temperature sensing units.

To increase utility, controlling a transfer of heat to and from a tank may comprise determining an amount of available heat to transfer from the tank in dependence on the tank status and, optionally, an anticipated heating demand. The anticipated heating demand may be an anticipated defrosting demand, and/or an anticipated space heating demand, and/or an anticipated hot water demand. The amount of available energy may be determined from a temperature profile using integration methods.

To increase flexibility, determining the amount of available heat may comprise determining a quantity of available heat for defrosting the heat pump and/or a quantity of available heat for satisfying a space heating demand and/or a quantity of available heat for satisfying a hot water demand.

For versatility the method may include controlling a transfer of heat from the water heating system to the heat pump, preferably for defrosting the heat pump. For versatility the method may include controlling a transfer of heat from the water heating system to the space heating system. For robustness the method may include controlling one or more actuators to configure the heating system to one of several configurations. For ease of implementation the actuators may be two diverter valves; or a diverter valve and a circulation pump.

The method may be adapted to use a controller as aforementioned.

The method may be adapted to control the system as aforementioned.

According to a further aspect there is provided a heating system including: a heat pump to provide heat; a circuit of heat transfer fluid to transfer heat to or from the heat pump; a space heating system configured to transfer heat from the heat transfer fluid to an environment; a water heating system comprising a tank, a cold water inlet, a hot water outlet for drawing off hot water, and a heat exchanger configured to exchange heat between the heat transfer fluid and water from the cold water inlet; and a controller adapted to control the transfer of heat to and from the tank. Advantageously, the system may allow the tank to act as a virtual buffer tank such that heat from the tank may be transferred not just to water to be heated, but to a space heating system or back to the heat pump. A separate buffer tank need not be installed providing a simplified heating system. The tank may be used to store additional heat from the heat pump to be transferred back to the heat pump or space heating system at a later time. This can reduce the number of on/off cycles required of the heat pump.

Any apparatus feature as described herein may also be provided as a method feature, and vice versa.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

As used herein the terms 'heat' and 'thermal energy' are interchangeable.

BRIEF DESCRIPTION OF THE SEVERAL VIEWS OF THE DRAWINGS

These and other aspects of the present invention will become apparent from the following exemplary embodiments that are described with reference to the following figures in which.

DESCRIPTION OF SPECIFIC EMBODIMENTS OF THE INVENTION

Figure 1:
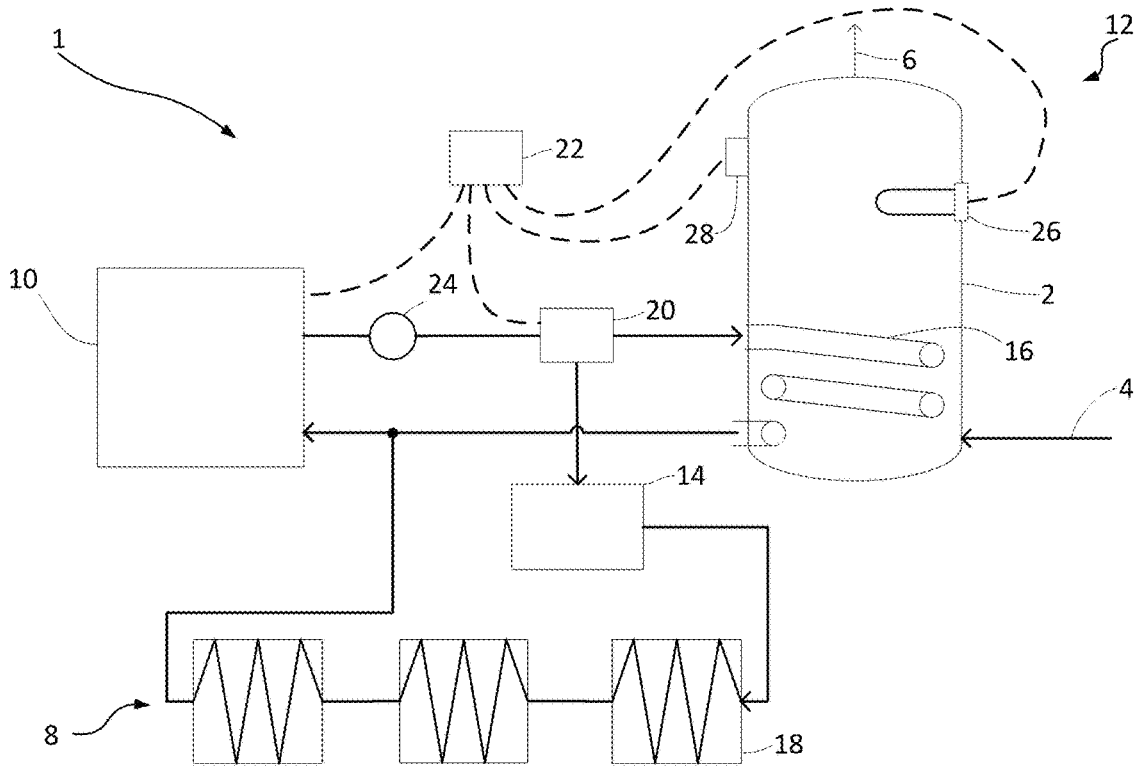
FIG. 1 is a schematic of a conventional heating system.

FIG. 1 shows a conventional heating system 1 with a tank 2 having a cold water inlet 4 and a hot water outlet 6 for drawing off hot water. A heat pump 10 is arranged to provide heat to the tank 2 or to a space heating system 8. A mechanical safety control thermostat 28 is provided at the tank 2. A heat exchanger 16 (a coil inside the tank 2) is arranged to provide heat from the heat pump 10 to water in the tank 2. An electrical heating element 26 is arranged in the tank 2 to provide heat to water in the tank 2, for example if the heat delivered form the heat pump 10 is not sufficient to cover a hot water demand. The heat pump system 1 further includes a buffer vessel 14, in the illustrated example shown in a fluid circuit with a number of radiator elements 18 of the space heating system 8. A three-port diverter valve 20 is arranged to divert heat transfer fluid from the heat pump 10 either to the tank 2 or to the buffer vessel 14 and the space heating system 8. A controller 22 controls the heat pump 10, the diverter valve 20, the safety control thermostat 28 and the electrical heating element 26. A circulator pump 24 is arranged to pump heat transfer fluid from the heat pump 10 to the heat exchanger 16 at the tank 2 or to the space heating system 8.

In an example, the heat source is at approximately 65° C., and the water in the tank is to be heated to a temperature suitable for use, e.g. 62° C. (typically above 50° C. to minimise the risk of exposure to *Legionella* or other pathogens, and below 70° C. to minimise the risk of scalding).

The tank 2 is preferably a tank for storing and heating water for onward supply to a user. The tank is conveniently for pressurised storage of potable water. Examples of such tanks are also known as unvented hot water cylinders. Such tanks are capable of operating under pressure and at elevated temperatures, while being corrosion resistant and not contaminating stored water. A pressurised tank can distribute hot water throughout a building without needing any pumps. By heating water in the tank for onward supply to a user, losses can be avoided that might otherwise occur and efficient use of mains water pressure can be made. For example if the tank contained a heat transfer fluid that is heated, then further heat transfer to water for supply to a user would be required, imposing an efficiency penalty.

Figure 2:
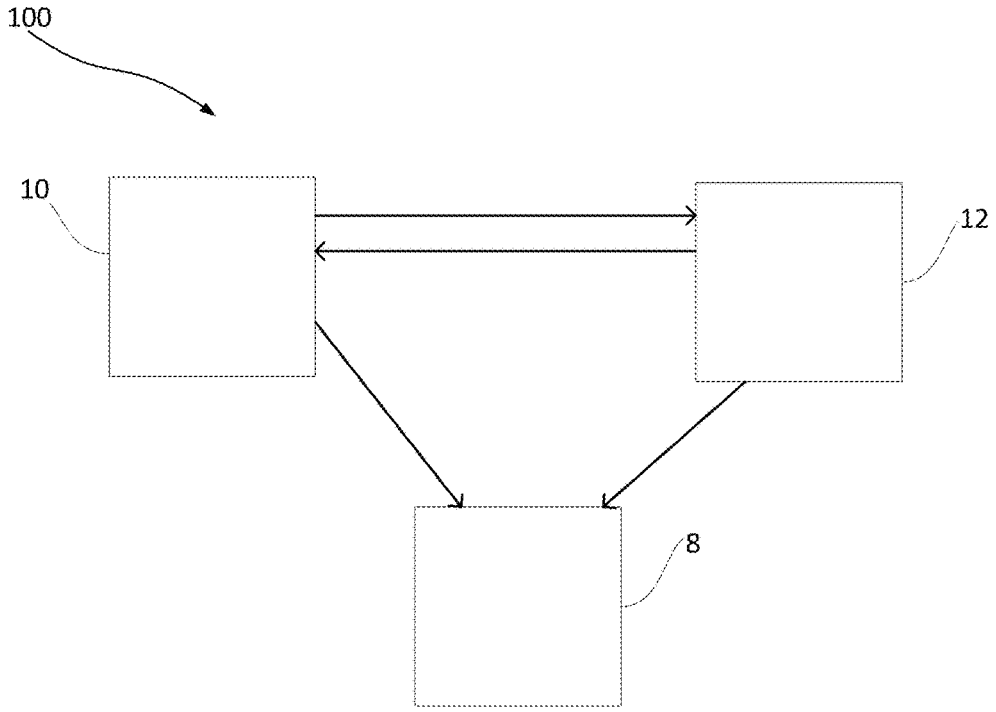
FIG. 2 is a schematic of a heating system.

FIG. 2 shows a schematic of a heating system 100 designed to omit the buffer tank of the example shown in FIG. 1, while still providing heat buffering capability. A heat pump 10, a space heating system 8, and a water heating system 12 are provided. In FIG. 2 the possible flows of heat are shown schematically with arrows. In one configuration, the heat pump 10 provides heat to the water heating system 12. In another configuration, the water heating system 12 provides heat to the space heating system 8. In another configuration, the heat pump 10 provides heat to the space heating system 8. In another configuration, the water heating system 12 provides heat to the heat pump 10. The heating system 100 is controlled to use the water heating system 12 both to heat water for a hot water supply, and also to provide heat buffering for the heat pump 10 and the space heating system 8.

Figure 3:
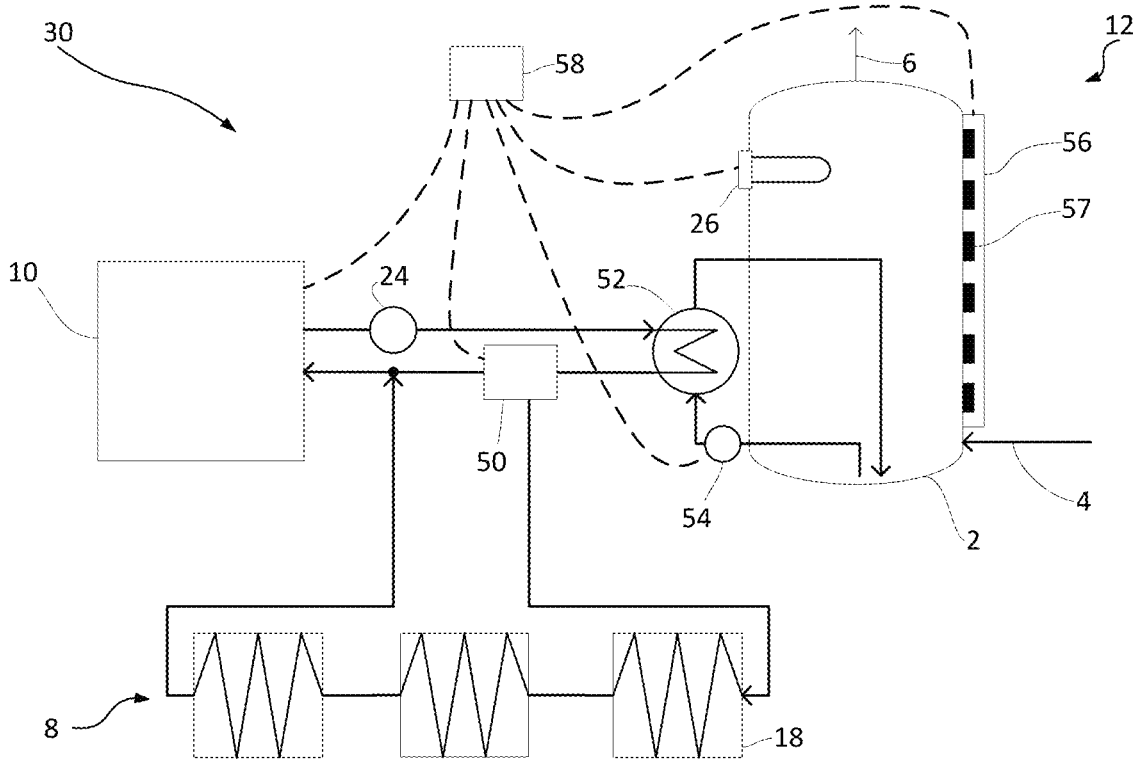
FIG. 3 is a schematic of a first example of a heating system.

FIG. 3 shows an example of a heating system 30 according to FIG. 2. Components like those included in the conventional heating system of FIG. 1 are indicated with like reference numbers.

Heat exchange between the heat pump 10 and the tank 2 is enabled by a heat exchanger 52. A circulator pump 54 is arranged to pump water from the tank 2 to the heat exchanger 52 (e.g. a plate heat exchanger) and back to the tank 2 again. A three-port diverter valve 50 is arranged downstream of the heat exchanger 52 in the heat transfer fluid circuit. The diverter valve 50 is arranged to divert heat transfer fluid either to the space heating system 8, or back to the heat pump 10 bypassing the space heating system 8.

A controller 58 is coupled to the circulator pump 54 and the diverter valve 50 to control transfer of heat.

In a first configuration:

the heat pump provides heat;

the circulator pump 54 is on such that heat is transferred into the tank 2; and the diverter valve 50 diverts heat transfer fluid to the space heating system 8.

In this configuration space heating is provided and the tank 2 is heated. In an alternative, the circulator pump may be off such that heat is only transferred to the space heating system.

In a second configuration:

the heat pump provides heat;

the circulator pump 54 is on such that heat is transferred into the tank 2; and the diverter valve 50 diverts heat transfer fluid directly back to the heat pump 10 instead of to the space heating system 8.

In this configuration the tank 2 is heated, while space heating is suspended (e.g. when a desired room temperature has been reached).

In a third configuration:

the heat pump does not provide heat;

the circulator pump 54 is on such that heat is transferred from the tank 2 to the heat transfer fluid; and the diverter valve 50 diverts heat transfer fluid to the space heating system 8.

In this configuration space heating is provided from heat held by the tank 2.

In a fourth configuration:

the heat pump does not provide heat;

the circulator pump 54 is on such that heat is transferred from the tank 2 to the heat transfer fluid; and the diverter valve 50 diverts heat transfer fluid directly back to the heat pump 10.

In this configuration heat is provided to the heat pump 10 from heat held by the tank 2, for instance for a defrosting cycle of the heat pump.

By controlling the circulator pump 54 and the diverter valve 50 heat can be transferred into the tank 2, into the space heating system 8, or out from the tank 8 into the space heating system 8, or out of the tank 2 into the heat pump 10 during a defrost cycle.

A sensor 56 is arranged at the tank 2 to provides information regarding a quantity of thermal energy stored in the tank. This can inform whether the tank 2 can usefully receive heat or not, and whether it can provide heat to the space heating system 8 or to the heat pump 10, or not. If the tank 2 contains water that is already heated to the desired temperature, then it is not advantageous for the tank to receive more heat. If water is overheated it might cause scalding when drawn, and more drastic overheating can cause activation of tank safety features such as the mechanical control thermostat. If the tank 2 contains water that is not yet at the desired temperature, then it can usefully receive more heat.

In the tank 2 it is intended to heat water such that hotter, less dense water forms a distinct layer at the top of the tank, with the proportion of hot water (e.g. above a threshold temperature) increasing as heat is received. The sensor 56 can resolve the state of charge of the tank by virtue of a number of temperature sensing units 57 arranged vertically along the tank 2. In a tank 2 containing thermally stratified water with a well-defined thermocline (where there is a relatively abrupt temperature change), the position of the thermocline can permit determining a proportion of hot water in the tank as an indication of the state of charge of the tank. The sensor 56 can establish to what extent the tank 2 is already heated and to what extent it can be heated further. The sensor 56 can provide a tank status indicating whether the tank 2 can safely receive heat, or if the tank 2 is at or near its intended heat capacity and further heating is not appropriate, and also whether the tank 2 can provide heat to the space heating system 8 or to the heat pump 10 for defrosting.

The controller 58 is coupled to the sensor 56 and the heat pump 10, which permits establishing an operational state of the heat pump 10 (whether the heat pump is providing heat, or not, or regarding a defrost cycle) and the tank 2 (whether the tank 2 can receive or provide heat or not).

Figure 4:
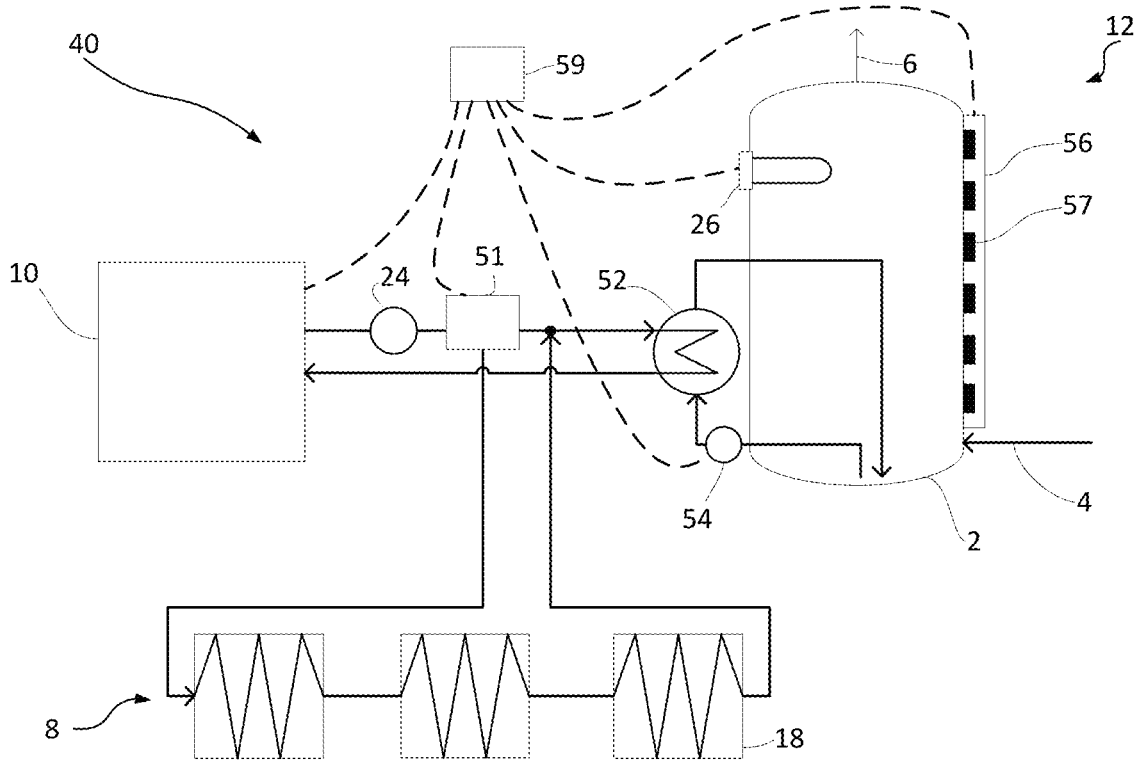
FIG. 4 is a schematic of a second example of a heating system.

FIG. 4 shows another example of a heating system 40. This example is similar to that shown in FIG. 3, but a diverter valve 51 is arranged upstream of the heat exchanger 52 instead of downstream of it. The diverter valve 51 diverts heat transfer fluid either to the space heating system 8, or to the water heating system 12 and from there back to the heat pump 10 (without passing through the space heating system 8). The return flow from the space heating system 8 feeds in at a junction between the diverter valve 51 and the heat exchanger 52, so as to return the flow to the heat pump 10 via the heat exchanger 52.

The controller 59 controls the circulator pump 54 and the diverter valve 51 to transfer heat into the tank 2, into the space heating system 8, or out from the tank 8 into the space heating system 8, or out of the tank 2 into the heat pump 10 during a defrost cycle.

Figure 5:
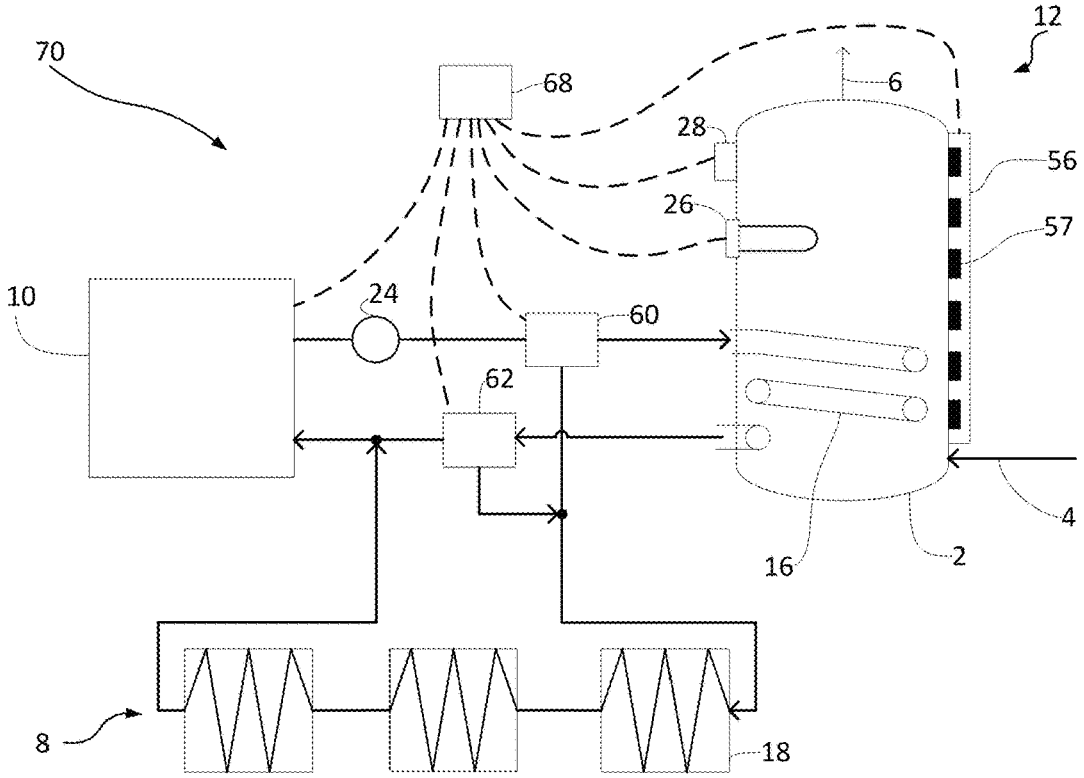
FIG. 5 is a schematic of a third example of a heating system.

FIG. 5 shows another example of a heating system 70. The circulator pump and the heat exchanger included in the examples illustrated in FIGS. 3 and 4 are omitted, and instead a heat exchange coil 16 inside the tank 2 is provided. A first three-port diverter valve 60 is arranged upstream of the coil 16. The first diverter valve 60 is arranged to divert heat transfer fluid either to the coil 16 in the tank 2, or to a space heating system 8. A second three-port diverter valve 62 is arranged downstream of the coil 16. The second diverter valve 62 is arranged to divert heat transfer fluid either to the space heating system 8, or back to the heat pump 10 bypassing the space heating system 8.

By controlling the first diverter valve 60 and the second diverter valve 62 heat can be transferred into the tank 2, into the space heating system 8, or out from the tank 8 into the space heating system 8, or out of the tank 2 into the heat pump 10 during a defrost cycle.

A controller 68 is coupled to the first diverter valve 60 and the second diverter valve 62 to control transfer of heat. The controller 68 is coupled to the sensor 56 and the heat pump 10, which permits establishing an operational state of the heat pump 10 (whether the heat pump is providing heat or not or regarding a defrost cycle) and the tank 2 (whether the tank 2 can receive or provide heat or not).

Figure 6:
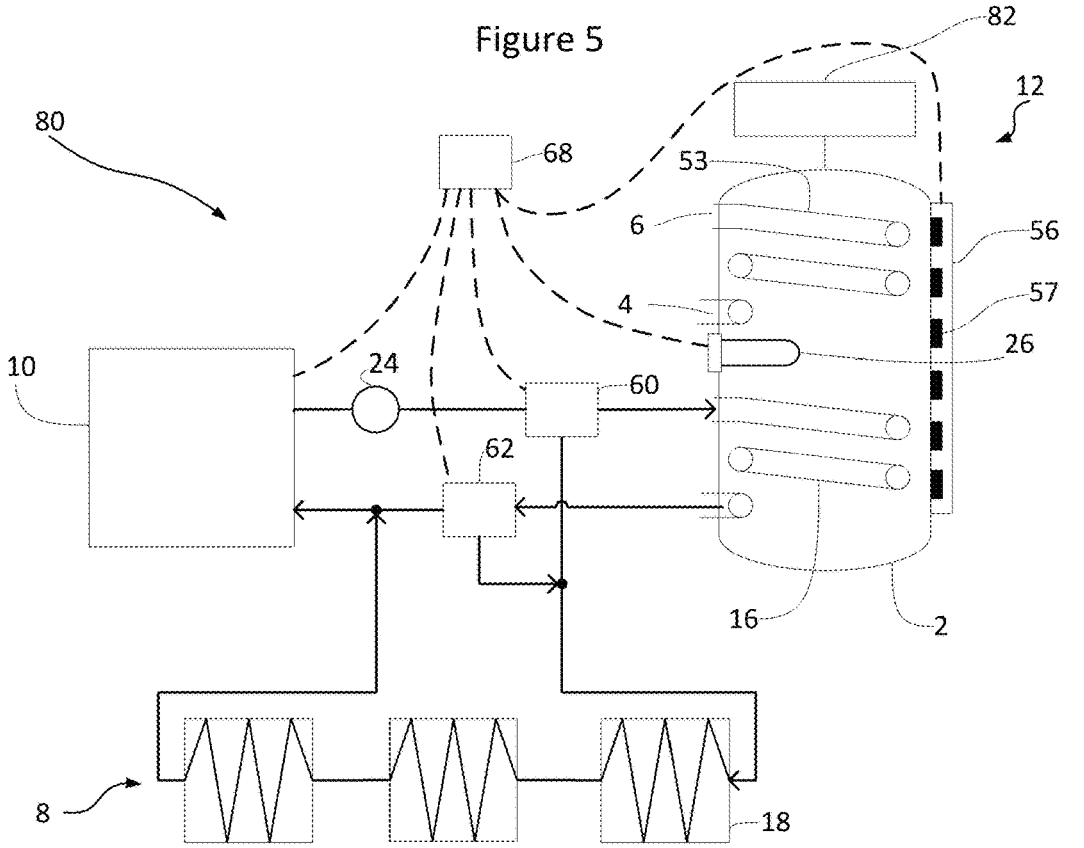
FIG. 6 is a schematic of a fourth example of a heating system.

FIG. 6 shows another example of a heating system 80. This example is similar to that shown in FIG. 5, but the tank 2 is used as a thermal store and is not for storing potable water. The fluid in the tank may be water, or any suitable heat transfer fluid. A heat exchange coil 16 is arranged inside the tank 2 to exchange heat with the heat transfer fluid of the circuit connecting the heat pump 10. A further heat exchanger for heating cold water is provided in the upper portion of the tank 2. In the illustrated example, the heat exchanger is a heat exchange coil 53 inside the tank and has a cold water inlet 4 for introducing cold (potable) water into the heat exchanger to be heated by the fluid in the tank 2 via the heat exchanger. The hot water is drawn off for use via a hot water outlet 6. The tank 2 is not mains pressurised since it is not filled with cold water from the mains, and hence can be a vented tank that requires fewer safety devices (in particular, there is no need for a thermal relief valve as otherwise required in an unvented mains pressurised tank). In the illustrated heating system 80 the tank 2 is a vented tank with a header tank 82 disposed above the tank. Similarly as described with reference to FIG. 3, a sensor 56 provides information regarding whether the tank 2 can usefully receive or provide heat or not.

In a variant of heating system 80, the heat transfer fluid of the circuit connecting the heat pump 10, space heating system 8 and the tank 2 may directly flow into and out of the tank 2 such that the tank can permit storage of heated heat transfer fluid, similar to a conventional buffer tank. In this case the heat exchange coil 16 of FIG. 6 is omitted. The tank 2 is then both a buffer tank for the heat transfer fluid and arranged to heat a cold water inlet 4 by transfer of heat from the heated heat transfer fluid in the tank via the upper heat exchanger.

By controlling the first diverter valve 60 and the second diverter valve 62 heat can be transferred into the tank 2, into the space heating system 8, or out from the tank 8 into the space heating system 8, or out of the tank 2 into the heat pump 10 during a defrost cycle.

A controller 68 is coupled to the first diverter valve 60 and the second diverter valve 62 to control transfer of heat. The controller 68 is coupled to the sensor 56 and the heat pump 10, which permits establishing an operational state of the heat pump 10 (whether the heat pump is providing heat or not or regarding a defrost cycle) and the tank 2 (whether the tank 2 can receive or provide heat or not).

Figures 7A, 7B:
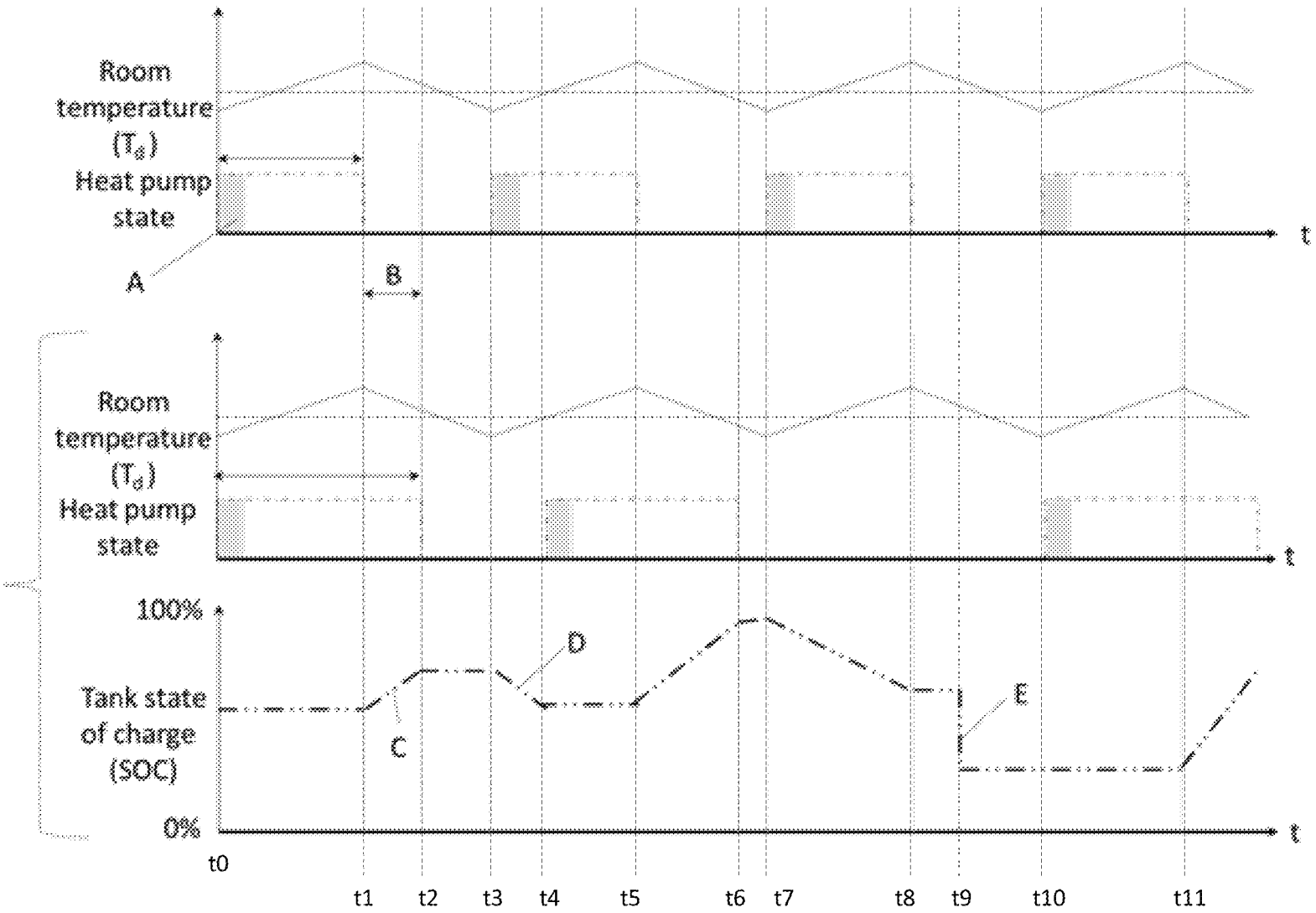
FIG. 7A is a graph of room temperature and heat pump state over time in an exemplary prior art system.
FIG. 7B is a graph of room temperature, heat pump state and tank state of charge over time in an exemplary heating system with a virtual buffer tank.

FIG. 7A is a graph of room temperature and heat pump state against time, illustrating operation of a prior art heating system 1 such as that illustrated in FIG. 1. FIG. 7B is a graph of room temperature, heat pump state and tank state of charge against time for a system according to the present disclosure.

In FIG. 7A, the room temperature of a room heated by a conventional heating system oscillates around the target temperature of the room. At time t=t0, when the temperature of the room (as termed herein a dwelling temperature Td) has dropped to a lower threshold temperature (as termed herein a setpoint temperature Ts) below the target temperature, the heat pump is switched on (event 'A') to deliver heat to the space heating system in order to heat the room. The temperature of the room rises until it exceeds the target temperature, and once an upper threshold temperature, Ts+hs, above the target temperature is reached the heat pump is switched off. The temperature of the room then drops until it is below the target temperature and the cycle repeats.

In FIG. 7B, an operation of the present system is illustrated. The operation begins similarly, at time t=0 with the temperature of the room having dropped to the lower threshold below the target temperature, and the heat pump is switched on and delivers heat to the space heating system in order to heat the room. It can be seen that heat is not being delivered to the tank, since the state of charge of the tank during remains constant (i.e. the tank is not being heated). The operation of the heating system may therefore correspond, for example, to the first configuration of the heating system described above with the circulator pump turned off.

At time t=t1, when the room temperature reaches the upper threshold temperature above the target temperature, the heat pump remains on but the heat is delivered to the water heating system, and not to the space heating system. The state of charge of the tank will therefore increase (feature 'C') and the room temperature will drop. This may correspond to the second configuration described above. The period labelled 'B' therefore represents an extension to the on time of the heat pump with respect to the prior art system of FIG. 7A.

At time t=t2, the tank has reached an acceptable state of charge and room temperature has not yet dropped to the lower threshold temperature. The heat pump is switched off and no heat is being delivered either to the tank or to the heating system. The state of charge of the tank remains constant, and the room temperature continues to drop.

At time t=t3, the room temperature has dropped to the lower threshold below the target temperature and so heat must be delivered to the space heating system. The heat pump remains off, and heat is transferred from the tank to the space heating system. The state of charge of the tank thus decreases (feature 'D') as heat is transferred from the tank to the space heating system and the room temperature increases. This may correspond to the third configuration described above.

At time t=t4, the heat pump is switched on and takes over from the tank in providing heat to the space heating system. The heat pump transfers heat to the space heating system so the room temperature continues to increase. No heat is being provided from the heat pump to the tank, nor is any heat being taken from the tank, so the state of charge of the tank remains constant. This may again correspond to the first configuration (with the circulator pump switched off) described above.

At time t=t5, the room temperature once again reaches the upper threshold temperature above the target temperature, so the heating system no longer requires heat. The heat pump stops heating the space heating system and switches to heat the tank. This may once again correspond to the second configuration described above. The heating system remains in this configuration until the tank reaches approximately a full state of charge.

At time t=t6, the tank has reached a full state of charge and the heat pump is switched off. The room temperature has not yet dropped below the lower threshold so the heating system does not require heat. The room temperature continues to drop and the state of charge of the tank remains constant.

At time t=t7, the room temperature reaches the lower threshold value and so the heating system requires heat. The heat pump remains off and the heat is delivered from the tank to the space heating system. The state of charge of the tank therefore decreases and the temperature of the room increases. This may once again correspond to the third configuration described above.

At time t=t8, the room temperature reaches the upper threshold value and so no more heat need be transferred from the tank to the space heating system. The state of charge of the tank is still sufficient that no heat is required from the heat pump to the tank. The heat pump remains switched off. The temperature of the room thus begins to drop and the state of charge of the tank remains constant.

At time t=t9, hot water is drawn from the tank. This reduces the state of charge of the tank on a very short timescale. It is determined that there is no pressing need to increase the state of charge of the tank, and the room temperature has not yet dropped to the lower threshold temperature, so the heat pump remains off.

At time t=t10, the temperature of the room has dropped to the lower threshold and so the heat pump is switched on and delivers heat to the space heating system in order to heat the room. Heat is not delivered to the tank. The operation of the heating system may correspond to the first configuration of the heating system described above with the circulator pump turned off.

At time t=t11, when the room temperature reaches the upper threshold value the heat pump remains on but the heat is delivered to the water heating system, and not to the space heating system. The state of charge of the tank will therefore increase whereas the room temperature will begin to drop. This may correspond to the second configuration described above.

It can be seen that over the illustrated time period, the number of on/off cycles of the heat pump has been reduced from four to three by virtue of using the tank of the water heating system as a virtual buffer.

Figure 8:
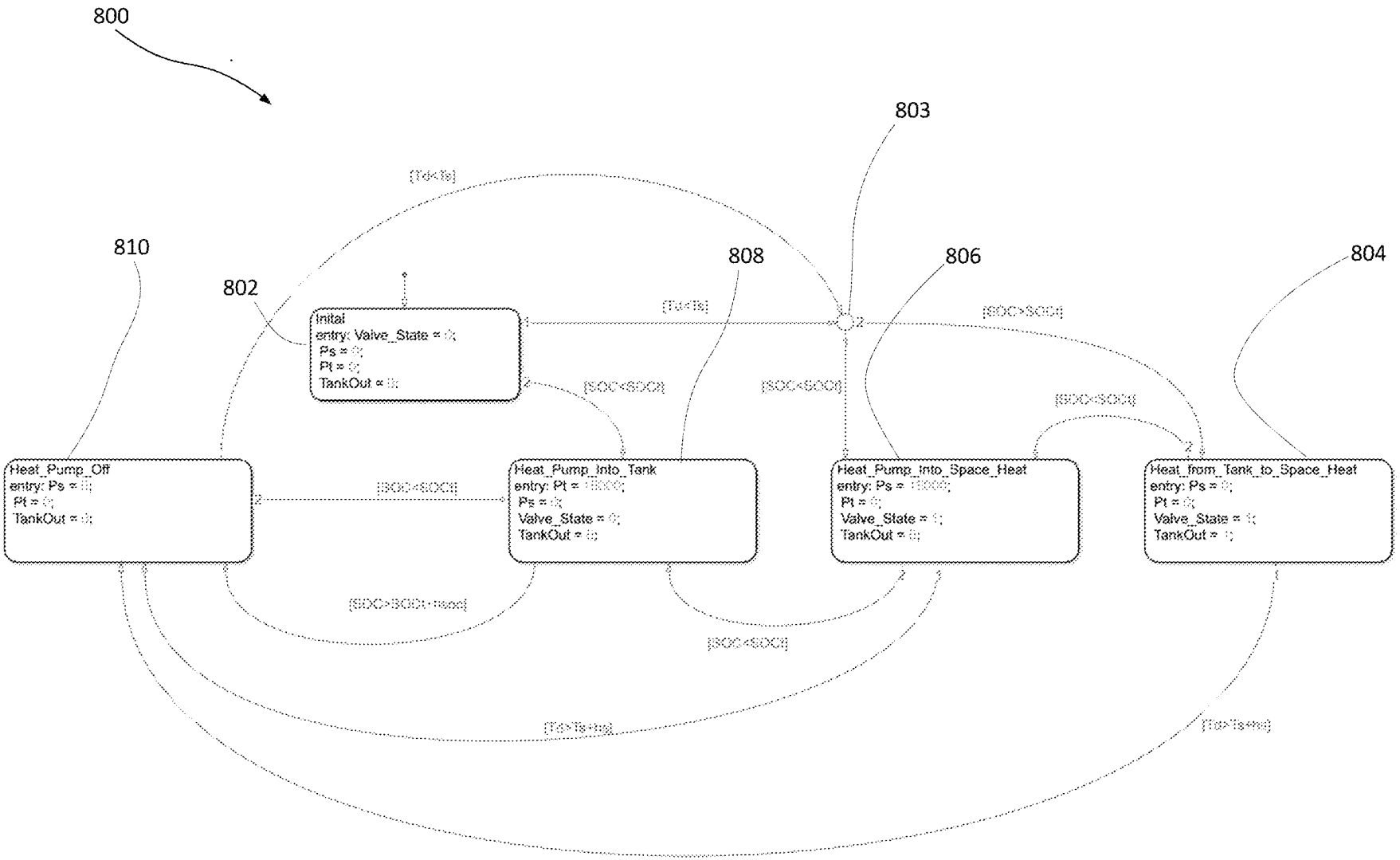
FIG. 8 is a state machine diagram of an exemplary heating system with a virtual buffer tank.

FIG. 8 illustrates the operation of the heating system as a state machine diagram 800 showing an exemplary set of conditions required to transitions between states 802, 804 806, 808, and 810 or configurations of the heating system. Nodes of the diagram represent states 802, 804 806, 808, and 810 or decision points 803 of the system and arrows between nodes of the diagram represent conditions to be fulfilled in order to allow the transition between the two connected nodes. Arrows labelled 1 indicate that this condition is assessed first, and if true the state transformation indicated by arrow 1 occurs. If that condition is false, then the condition of arrow 2 assessed. If the condition is true then the transition indicated by arrow 2 occurs. If all the conditions are false, then the state does not change.

The system begins in an initial state 802. If the temperature Td of the room is less than the set point temperature Ts, then space heating is required. A decision 803 is made whether to deliver the heat from the heat pump or from the tank. If the state of charge of the tank (SOC) is greater than a threshold state of charge SOCt then the heat is to be delivered from the tank to the space heating system, and the heating system transitions into state 804 (corresponding, for example, to the third configuration described above). If the state of charge of the tank is less than the SOCt, then there is insufficient charge in the tank to deliver to the space heating system, so the heat must be delivered from the heat pump to the space heating system. The system transitions into state 806 (corresponding, for example, to the first configuration described above).

In the initial state, if Td>Ts then no heating to the space is required. It is then assessed whether heating to the tank is required. If SOC<SOCt then heating is required and the heating system transitions into state 808 such that heat is delivered from the heat pump to the tank (corresponding, for example, to the second configuration described above).

In state 804 the space heating system is being heated by the tank. If the temperature of the room exceeds Ts+hs then no further heating is required and the tank may stop delivering heat to the space heating system and the heat pump may be turned off since neither tank nor space heating system require heat. The system may transition to state 810.

In state 804, if Td<Ts+hs and SOC<SOCt then the tank is no longer able to deliver heat to the space heating system, but the space heating system still requires heat. The system may therefore transition to state 802.

In state 806, the space heating system is being heated by the heat pump. If Td>Ts+hs then the space no longer requires heat and the heat pump may be turned off. The system transitions to state 810.

In state 806, if Td<Ts+hs and SOC<SOCt then both the space heating system and the tank require heat. In this example, the needs of the tank are prioritised and the system transitions to state 808 to heat the tank from the heat pump.

In state 808 the heat pump is heating the tank. If SOC>SOCt+hsoc then the tank no longer requires heat and the heat pump is turned off. The system transitions to state 810.

In state 810 the heat pump is off. If Td<Ts then the space heating system requires heat. The decision at decision 802 must then be made whether to deliver that heat from the heat pump or the tank in dependence on the state of charge of the tank.

In state 810, if Td>Ts then the space heating system does not require any heat. If Td>Ts and SOC<SOCt then the tank will be heated by the heat pump. The system will transition into state 808.

It will be appreciated that in this simplified example, in some scenarios the needs of the tank are prioritised over the needs of the space heating and vice versa. The choices made are exemplary. A further state for delivering heat from the tank to the heat pump (for example, for defrosting the heat pump) is omitted for simplicity but may also be included.

Figure 9A:
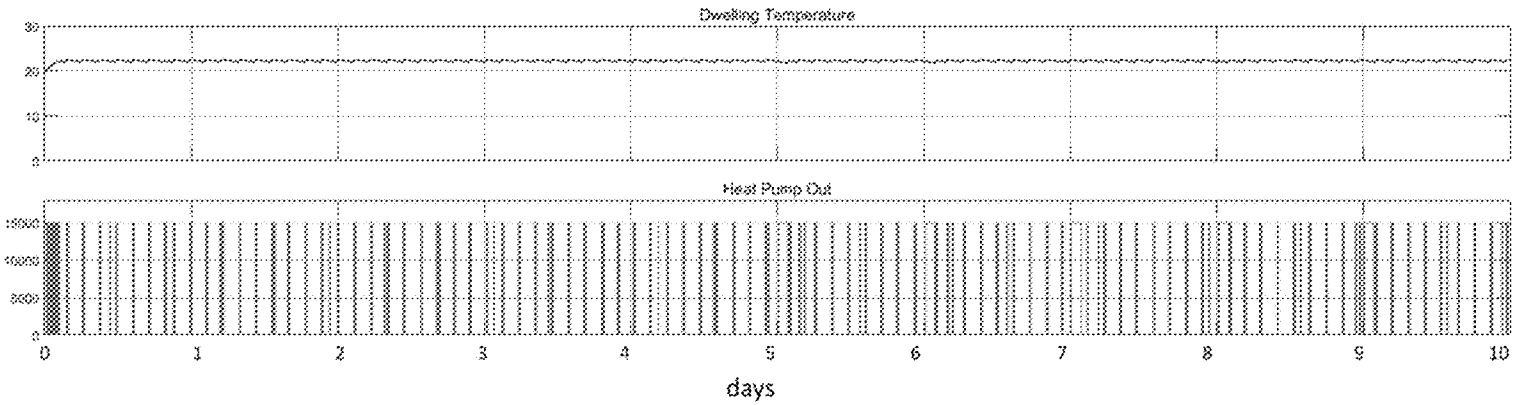
FIG. 9A is a graph of dwelling temperature and heat pump output for a simulated dwelling having a prior art heating system.
Figure 9B:
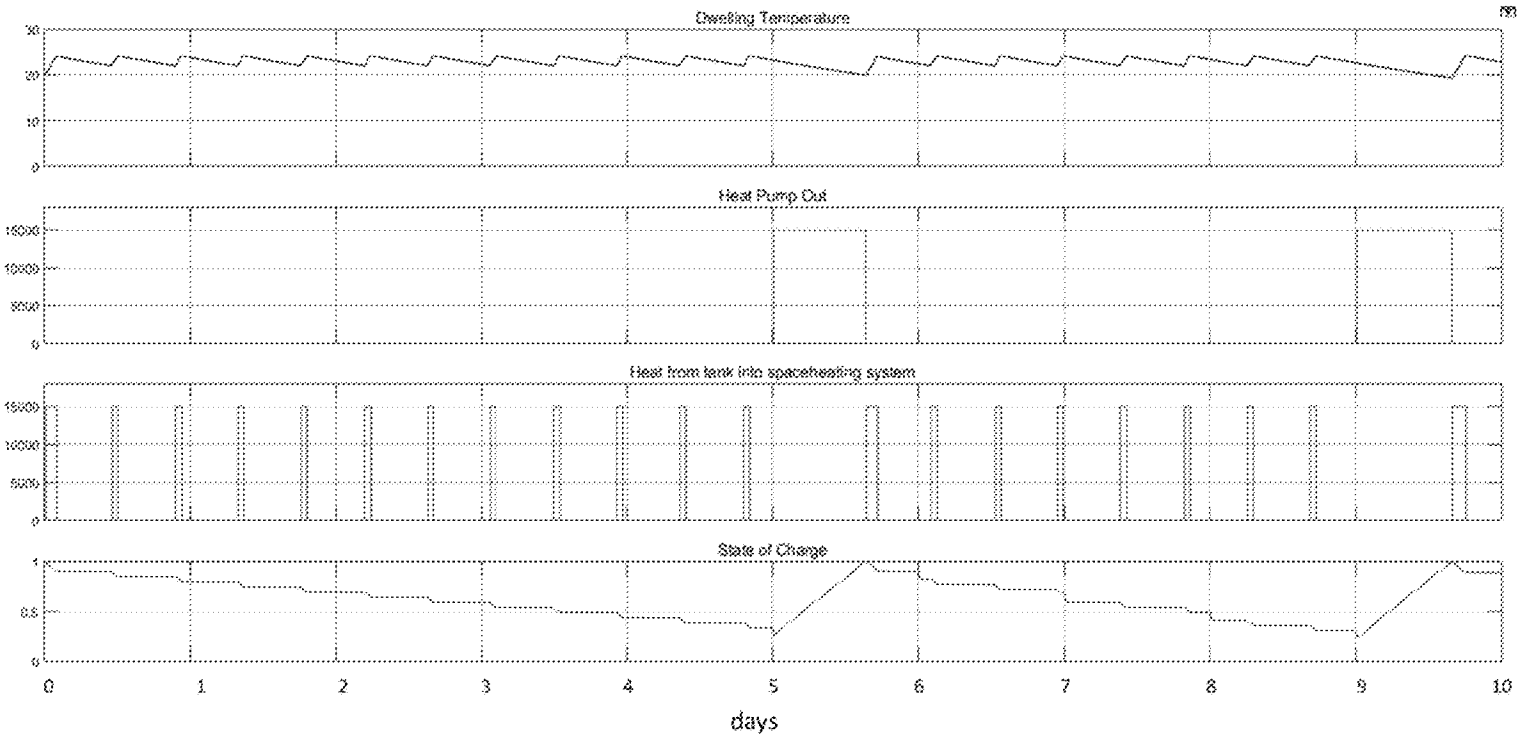
FIG. 9B is a graph of dwelling temperature, heat pump output, heat output from tank to heating system, and tank state of charge over time for a simulated dwelling having a heating system with a virtual buffer.

FIG. 9A shows simulation data of a heating system without particular heat buffering capabilities over a period of 10 days. FIG. 9B shows simulation data of a heating system including combined water heating and heat buffering as the examples shown in FIGS. 3-6 over the same time period. It can be seen that the number of heat pump on/off cycles is substantially reduced in FIG. 9B.

In FIG. 9A the upper panel illustrates the temperature over time of the dwelling being heated by a space heating system which receives heat from the heat pump. The lower panel illustrates the output of the heat pump over time. It can be seen that each time the dwelling temperature reaches a set point temperature the heat pump is triggered to heat the system. The heat pump cycles on and off several times a day in order to maintain the temperature in a comfortable range.

In FIG. 9B, the uppermost panel shows the familiar oscillation of the dwelling temperature around the desired temperature.

The upper middle panel show the output of the heat pump over time. It can be seen that over the same period as shown in FIG. 9A only two heat pump on/off cycles occur.

The lower middle panel shows the output from the tank into the space heating system, with the tank acting as a buffer vessel from which heat may be drawn to space heating system as an alternative to the heat pump. It can be seen that when the dwelling temperature reaches the setpoint temperature, rather than deliver heat from the heat pump to the space heating system the heat is delivered from the tank.

The lowermost panel shows the state of charge of the tank over time. It can be seen that each time heat is delivered from the tank into the space heating system, the state of charge of the tank decreases. At day 5 and day 9, it can be seen that the heat pump is switched on to deliver heat to the tank as the state of charge has reached a threshold level. While the heat pump is on, the state of charge of the tank increase. It can be seen that in the illustrated example the heat pump is not delivering heat directly to the space heating system since the dwelling temperature continues to drop while the heat pump is on.

Figure 10B:
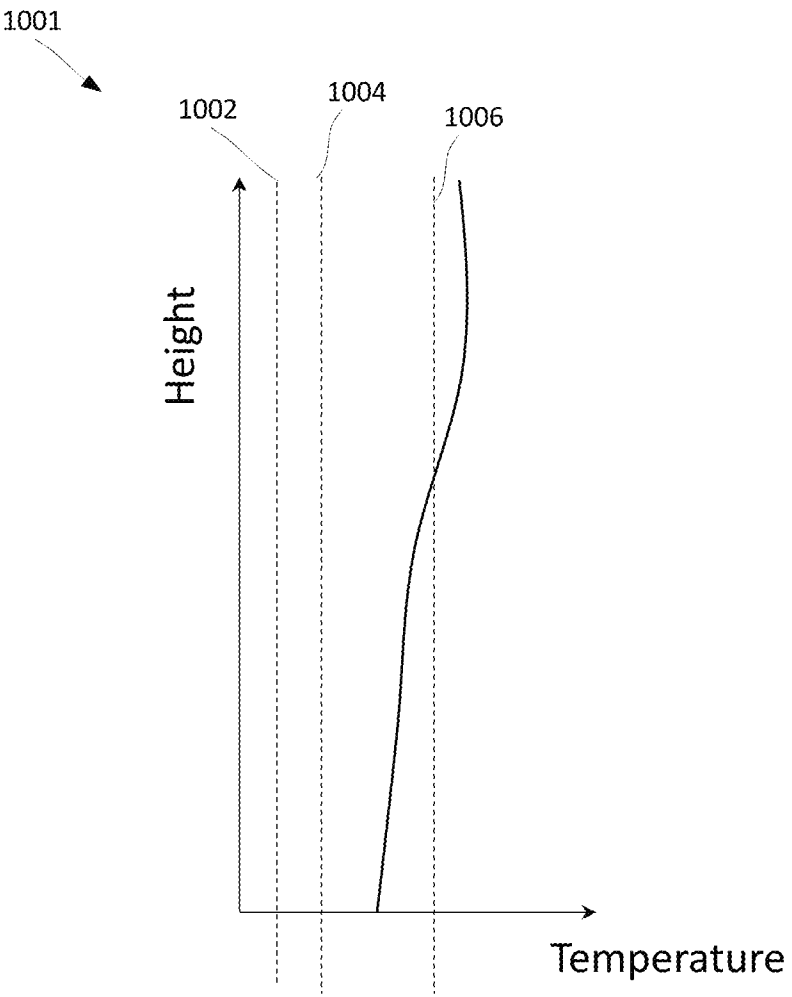
FIGS. 10A and 10B show two exemplary temperature profiles of a tank.
Figure 10A:
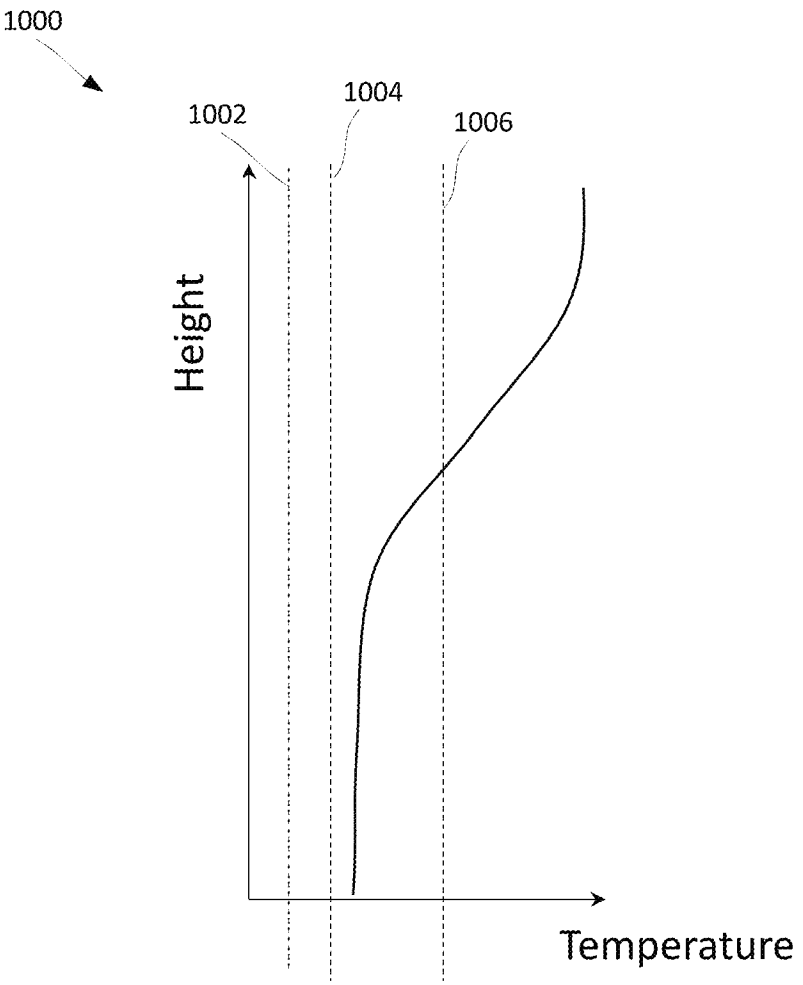

In FIG. 10A a first exemplary temperature profile 1000 of fluid across the height of a tank is shown. In this scenario, the temperature of the water is substantially constant (or only very gently increasing) in the lower portion of the tank, increases around the middle section of the tank, and once again becomes substantially constant in an upper region of the tank.

In FIG. 10B a second temperature profile 1001 of fluid across the height of a tank is shown according to a second exemplary scenario. The second scenario differs from the first scenario in that there is a greater volume of more moderately heated water. In both the first and second scenarios the total thermal energy in the tank is the same (the integral of the curves with respect to height in both scenarios is equal).

Indicated in FIGS. 10A and 10B are three relevant threshold temperatures. A first (lowest) threshold temperature is a defrost threshold temperature 1002. Fluid at a temperature greater than the defrost threshold temperature 1002 is suitable for defrosting a heat pump. A second threshold temperature is a space heating threshold temperature 1004. Fluid at a temperature greater than the space heating threshold temperature 1004 is suitable for heating the space heating system. A third threshold temperature is a hot water threshold temperature 1006. Fluid at a temperature greater than the hot water threshold temperature 1006 is suitable for providing potable hot water to be drawn off for use. It will be appreciated that the threshold temperatures may depend on the characteristics of the tank, the heat pump, the space heating system, the present and/or scheduled heating and hot water demands, time of day, time of year, the setting (e.g. domestic or office or public space). For instance, a defrost threshold temperature 1002 may be in the region of 20-30° C., a space heating threshold temperature 1004 may be in the region of 30-50° C. for an underfloor heating system or 40-60° C. for a heating system with radiators, and a hot water threshold temperature 1006 may be in the region of 60-70° C., but it will be evident that threshold temperatures outside these specific ranges may be suitable in some circumstances.

Sensors (such as the sensor 56 illustrated in FIGS. 3-6 with temperature sensing subunits arranged vertically along the tank) provide to the controller temperature readings such that a temperature profile of the fluid in the tank is known to the controller or may be approximated, for example, by interpolation between data points. Based on the temperature profile the controller may determine whether there is sufficient thermal energy available in the tank to be delivered to the space heating system or the heat pump or to satisfy an anticipated hot water demand.

The temperature profile of the tank may be indicative of a temperature profile of fluid in the tank. The temperature profile may indicate a number of temperatures associated with positions along the tank. The tank preferably has a uniform cross sectional area along its height, e.g. cylindrical, such that at each position along the tank height a near-constant quantity of fluid is at or near that height. This can permit particularly simple determination of a quantity of fluid at a particular sensed position and temperature, and accordingly of a quantity of thermal energy available from that portion of fluid. Summing up or integration of the temperature profile over the height of the tank can provide an indication of a quantity of thermal energy stored in the tank.

The controller computes an integral of the temperature profiles 1000 and 1001 above the different temperature thresholds to determine whether there is sufficient energy available for defrosting a heat pump or for space heating and/or how much energy may be taken from the tank given an anticipated hot water demand. The controller may optimise the amount of energy to be withdrawn from the tank to maximise the performance, for example an efficiency, of the heat pump while maintaining sufficient thermal energy to satisfy the anticipated hot water demand. In one example, the controller seeks to optimise the ratio of the time spent by the heat pump running at steady state to the time spent by the heat pump starting up.

In the second scenario illustrated in FIG. 10B the amount of thermal energy above the hot water threshold temperature available for providing hot water is less than in the first scenario illustrated in FIG. 10A. However, in the second scenario the amount of energy available for space heating is greater than in the first scenario. In both cases, there is a large amount of energy available for defrosting. The controller may therefore determine that in the second scenario heat may be transferred to the space heating system in order to satisfy a space heating demand whereas in the first scenario it is determined that heat is not to be transferred to the space heating system to satisfy the space heating demand since to do so would reduce the amount of fluid available to satisfy a hot water demand. The controller may control the heat pump to heat the space heating system instead.

The controller may determine from the temperature profile from the sensor data whether sufficient energy is available in the tank for transfer to the heat pump or to the space heating system or for satisfying a hot water demand. An anticipated demand of thermal energy from the tank—whether for defrosting the heat pump, for space heating or for hot water supply, can be estimated from heating system status data (e.g. environment temperature, whether a heat pump is on or off) and/or based on learned behaviour of the system. For example, a prediction algorithm may be trained on historic usage and/or performance data of the system. The anticipated hot water demand or space heating demand may for example be determined from historical usage data or a programmed schedule of the heating system.

In the example illustrated in FIG. 7B in one instance when sufficient heat has been provided from the heat pump to the room heating system, then heat is provided from the heat pump to the tank until the tank has reached a full state of charge (period t=t5 to t=t6), and then the heat pump is switched off. In another instance when sufficient heat has been provided from the heat pump to the room heating system, then heat is provided from the heat pump to the tank until another condition is fulfilled (period t=t1 to t=t2), without the tank having reached a full state of charge, and then the heat pump is switched off. Stopping heat transfer to the tank before the tank has reached a full state of charge may be useful for example if drawing electricity to drive the heat pump during peak grid load periods is to be avoided, or if a photovoltaic electricity supply for the heat pump drops below a threshold.

The controller may determine whether to transfer heat to the tank in dependence on availability of an electrical energy source, a peak or off-peak electrical energy period, or other factors for optimising use of electrical energy use by the heat pump.

In the example illustrated in FIG. 7B in one instance (at t=t9) hot water is drawn from the tank and it is determined that there is no pressing need to increase the state of charge of the tank, and the heat pump remains off. In another instance (at t=t7 to t=t8) heat is provided from the tank to the room heating system while the heat pump remains off. In this instance the state of charge at the end of the period, at t=t8, is still relatively high, and no action is taken to increase the state of charge of the tank. In another instance (at t=t3 to t=t4) heat is provided from the tank to the room heating system while the heat pump remains off, but then (at t=t4) the heat pump is switched on and takes over from the tank in providing heat to the space heating system. By switching from the tank to the heat pump the state of charge in the tank is prevented from dropping below a minimum quantity of hot water to remain available.

As illustrated in these scenarios, in some examples it may be useful to control the transfer of heat to and from the tank such that a minimum quantity of hot water remains available throughout for a user to draw hot water. A minimum quantity of hot water to remain available can be, for example, 20% of tank volume, or 25% of tank volume, or 30% of tank volume, or 40% of tank volume, or 50% of tank volume, or more, or less. A minimum quantity of hot water to remain available may for example be enough to satisfy a typical hot water draw event for a heating system (which may be a quantity established from analysis of historical use data). A minimum quantity of hot water to remain available can depend on factors such as tank size, user preference, time of day, time of year, weekday, or other factors.

The controller may determine whether to transfer heat from the tank in dependence on a minimum quantity of hot water to remain available, i.e. a minimum quantity of water with a temperature above a hot water threshold temperature (described in more detail with reference to FIGS. 10A and 10B). The controller can stop transfer of heat from the water heating system to the space heating system so as to maintain a minimum hot water quantity in the tank. In some examples a need for heat to defrost the heat pump may override the requirement for a minimum quantity of hot water to remain available, and in other examples a need for heat to defrost the heat pump may be stopped to preserve a minimum quantity of hot water in case of a user hot water requirement.

Figure 11:
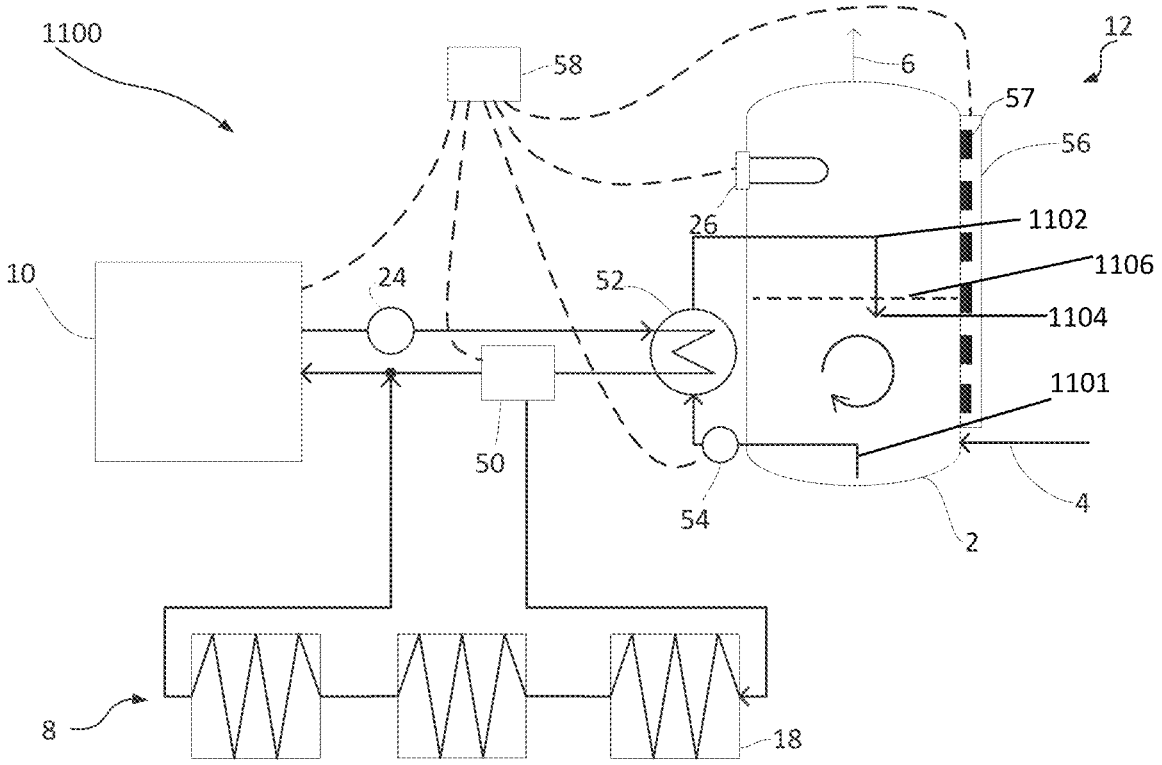
FIG. 11 is a schematic of a variant of the heating system shown in FIG. 3.

FIG. 11 illustrates a variant 1100 of the heating system 30 of FIG. 3. Similar features to the preceding figures are numbered with like references numerals and operate as described above. In FIG. 3, the circulator pump 54 pumps water from the bottom of the tank 2 to the heat exchanger 52 and back to the bottom of the tank 2 again. One disadvantage of this arrangement is that while heat may be delivered to the tank 2 by heating the drawn water and returning it to the bottom of the tank 2 (such as in the first and second configurations described in relation to FIG. 3), the arrangement of FIG. 3 may be less effective in extracting heat from the tank 2 (such as in the third and fourth configurations described in relation to FIG. 3). This is because when extracting heat from the tank 2 the water returned from the heat exchanger 52 is colder than that drawn from the tank 2 and is delivered to the bottom of the tank 2—this colder water has a lower buoyancy than the surrounding water so will stay at the bottom of the tank 2 rather than convectively mixing upwards. This means the water subsequently being drawn from the tank 2 will quickly become colder and thus less suitable for extracting heat from the tank 2. In effect there is only a small proportion of the water in the tank 2 available to provide buffer heating.

In FIG. 11, the heat exchanger return pipe 1102 is arranged to return water from the heat exchanger 52 to position above the position from which it was drawn. This colder water being introduced at a greater height encourages convection currents and mixing of the water in the lower region of the tank between the heat exchanger draw pipe 1101 and the return pipe outlet 1102. Thus a greater proportion of the volume of water in the tank 2 becomes available for extracting heat from the tank 2 to provide buffer heating. The proportion of water in the tank below the height of the return pipe outlet 1104 is available for "buffering" or extracting heat from the tank 2. The height of the return pipe outlet may be varied in order to vary the proportion of the tank available for buffer heating.

In the arrangement of FIG. 11, a baffle 1106 is also provided arranged at the height of the return pipe outlet 1104 or a small distance above the return pipe outlet 1104. In the illustrated embodiment the baffle 1106 is a perforated plate which extends across the full width and breadth of the tank 2. The baffle 1106 acts to reduce or prevent mixing of the water below the baffle 1106 with water above the baffle 1106. This serves to prevent de-stratification of water in the portion of the tank 2 above the baffle 1106 which might occur due to turbulence caused by the reintroduction of the heated or cooled water by the return pipe outlet 1104. The baffle 1106 may thus allow the portion of the tank 2 below the baffle 1106 to be a homogenous or mixed temperature zone while the portion above may remain stratified and without disturbance from the turbulence introduced by the water returned from the plate exchanger. The homogenous or mixed temperature zone may be particularly suitable for providing the "buffer" function of the tank with the stratified portion being particularly suitable for providing hot water to be drawn off for immediate use.

Figure 12:
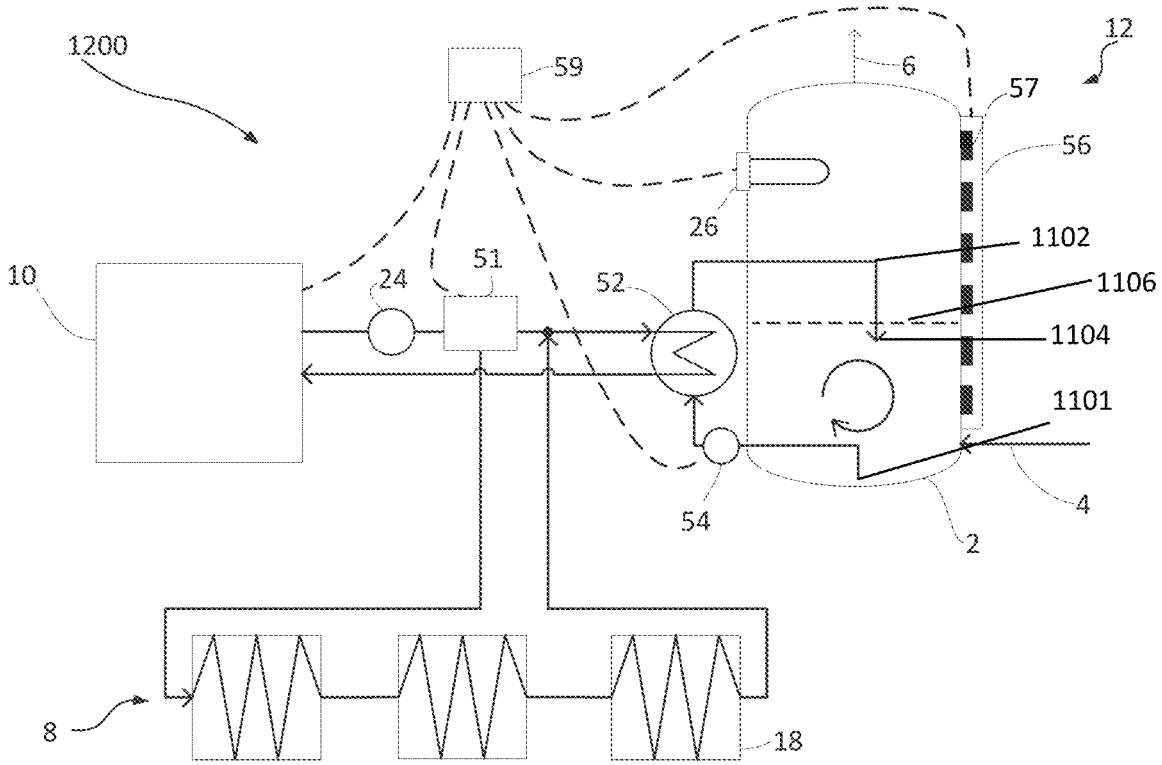
FIG. 12 is a schematic of a variant of the heating system shown in FIG. 4.

FIG. 12 illustrates a variant 1200 of the heating system 40 of FIG. 4 in which the heat exchanger return pipe 1102 is arranged similarly as illustrated in FIG. 11 such that the return outlet 1104 of the heat exchanger return pipe 1102 is arranged to return water from the heat exchanger 52 to position higher than the position from which the water was drawn. Similar features to the preceding figures have like reference numerals and operate as described above.

It will be appreciated that the heat exchangers described may take any one of a number of forms such as a simple plate heat exchanger or a heating water coil contained within a container arrangement.

For the sensor a number of specific sensor arrangements can be used. The sensor can resolve the state of charge of the tank, that is, to what extent the tank is already heated and to what extent it can be heated further, as described above. The sensor can resolve the state of charge of the tank, that is, a temperature profile of fluid in the tank, as described above. The sensor can do so by virtue of a number of temperature sensing units arranged vertically along the tank. The temperature sensing units can be external to the tank, but for good data in close proximity to the wall of the tank. In some examples a relatively small number of sensing units, potentially as few as 1 or 2 units, can suffice. A single sensing unit can in some examples give an indication as to whether a tank is already fully heated, or not, albeit that it would not provide an indication of how much more heat a tank can safely accept nor resolve how much energy is available above specific thresholds for different heating tasks (defrosting, space heating, hot water supply). In other examples a more precise resolution of the state of charge may be preferred and a larger number of sensing units may be included. In an example temperature is sensed every 2 cm, 5 cm, 10 cm, or 20 cm vertically along the tank.

The controller may be such that water is heated to a specific desired temperature, such as approximately 65° C., or 62° C. For many uses a suitable temperature is above 50° C. to minimise the risk of exposure to *Legionella* or other pathogens, and below 70° C. to minimise the risk of scalding, but other temperatures may be appropriate in some examples. In the example illustrated in FIG. 6 in particular the tank can be heated to a higher temperature if sufficient heat is available. The extent to which a tank can accept heat depends on the temperature to which the tank is to be heated.

The extent to which a tank can accept heat is particularly simple to determine if the water is thermally stratified and a thermocline is formed, and this is also particularly convenient for supplying hot water, but it can also be determined if the tank is not well thermally stratified and no thermocline is formed. The tank may include features to promote thermal stratification and formation of a thermocline, as are known.

Where the top of the tank is referred to herein (e.g. for drawing hot water from), it should be appreciated that this may include near the top of the tank, an upper portion of the tank, a top portion of the tank, a top half, third or quarter of the tank (by volume or by height), with the tank in such orientation as it is intended to be installed for use. Where the bottom of the tank is described (e.g. for letting in cold water, for pumping water to be heated from), it should be appreciated that this may include near the bottom of the tank, in a lower portion of the tank, or in a bottom half, third or quarter of the tank (by volume or by height), with the tank in such orientation as it is intended to be installed for use.

Various other modifications will be apparent to those skilled in the art.

It will be understood that the present invention has been described above purely by way of example, and modifications of detail can be made within the scope of the invention.

Reference numerals appearing in the claims are by way of illustration only and shall have no limiting effect on the scope of the claims.

The invention claimed is:

1. A heating system including:

a heat pump to provide heat;

a circuit of heat transfer fluid to transfer heat to or from the heat pump;

a space heating system configured to transfer heat from the heat transfer fluid to an environment;

a water heating system comprising a water tank for storing hot water to be provided to a user, a cold water inlet, a hot water outlet for drawing off hot water for supply to a user, and a heat exchanger configured to exchange heat between the heat transfer fluid and water from the cold water inlet;

a means of sensing a tank status, the tank status being indicative of a quantity of thermal energy stored in the tank; and a controller adapted to control the transfer of heat from the tank to the space heating system or heat pump in dependence on the tank status.

2. The system of claim 1, wherein the heat exchanger is a plate heat exchanger external to the tank.

3. The system of claim 1, wherein the controller is configured to control a transfer of heat from the water heating system to the heat pump for defrosting the heat pump.

4. The system of claim 1, wherein the tank status indicates one or more of:

a quantity of water stored in the tank above a temperature threshold, and the controller is configured to stop transfer of heat from the water heating system to the space heating system in order to retain a minimum hot water quantity in the tank;

whether the tank can safely receive heat; and a quantity of thermal energy stored in the tank above a temperature threshold.

5. The system of claim 1, wherein the tank status indicates a quantity of thermal energy stored in the tank above a temperature threshold and wherein the temperature threshold is associated with a minimum temperature for defrosting the heat pump or a minimum temperature for space heating or a minimum temperature for a hot water supply.

6. The system of claim 1, wherein the tank status is one or more of:

a state of charge of the tank;

a temperature profile of the tank; and in dependence on a position of a thermocline.

7. The system of claim 1, wherein the means of sensing a tank status comprises a plurality of temperature sensors arranged vertically along the tank.

8. The system of claim 1, wherein the controller is configured to determine an amount of available thermal energy to transfer from the tank in dependence on the tank status and/or in dependence on an anticipated heating demand.

9. The system of claim 8, wherein determining the amount of available thermal energy comprises determining a quantity of available heat for defrosting the heat pump and/or a quantity of available heat for satisfying a space heating demand and/or a quantity of available heat for satisfying a hot water demand.

10. The system of claim 1, further comprising one or more actuators controlled by the controller to configure the heating system to one of several configurations, wherein:

in a first configuration the heat pump provides heat to the space heating system and, in a second configuration the heat pump provides heat to the tank and does not provide heat to the space heating system;

in a third configuration the heat pump does not provide heat and the tank provides heat to the space heating system; and in a fourth configuration the heat pump does not provide heat and the tank provides heat to the heat pump.

11. The system of claim 10, wherein the actuators comprise two two-state actuators.

12. The system of claim 1, wherein a first actuator is configured to control a transfer of heat to and from the tank and a second actuator is configured to control a transfer of heat to the space heating system.

13. The system of claim 12 wherein the first actuator is a circulation pump configured to pump fluid through the heat exchanger; or wherein the first actuator is a diverter valve configured to control a flow of heat transfer fluid to the water heating system; or wherein the second actuator is a diverter valve configured to control a flow of heat transfer fluid to the space heating system.

14. The system of claim 1, wherein the controller is configured to determine an amount of available thermal energy to transfer from the tank in dependence on the tank status and an anticipated heating demand, wherein the anticipated heating demand is an anticipated defrosting demand, and/or an anticipated space heating demand, and/or an anticipated hot water demand.

15. A controller for a heating system, the controller including:

a sensor module configured to receive tank status data from one or more sensors associated with a water tank for storing hot water to be provided to a user and heating system data from one or more sensors associated with a heat pump or a space heating system, the tank status data being indicative of an amount of thermal energy stored in the tank; and a control module configured to control a transfer of heat from the tank to the heat pump or space heating system in dependence on the tank status data and the heating system data.

16. The controller of claim 15, wherein the control module is configured to control a transfer of heat from the water heating system to the heat pump for defrosting the heat pump.

17. The controller of claim 15, wherein the tank status is one or more of:

indicative of whether the tank can safely receive heat;

indicative of a quantity of thermal energy stored in the tank above a temperature threshold;

indicative of a quantity of water stored in the tank above a temperature threshold;

a state of charge of the tank;

a temperature profile of the tank; and a position of a thermocline.

18. The controller of claim 15, wherein the tank status indicates a quantity of water stored in the tank above a temperature threshold, and the control module is configured to stop transfer of heat from the water heating system to the space heating system in order to retain a minimum hot water quantity in the tank.

* * * * *